US008888271B2

(12) United States Patent
Spence et al.

(10) Patent No.: US 8,888,271 B2
(45) Date of Patent: Nov. 18, 2014

(54) AIR BEARING SUBSTRATE MEDIA TRANSPORT

(75) Inventors: James Joseph Spence, Honeoye Falls, NY (US); Norman David Robinson, Jr., Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 208 days.

(21) Appl. No.: 13/464,468

(22) Filed: May 4, 2012

(65) Prior Publication Data

US 2013/0293653 A1 Nov. 7, 2013

(51) Int. Cl.

| | |
|---|---|
| ***B41J 2/01*** | (2006.01) |
| *B41J 2/435* | (2006.01) |
| *B41F 1/28* | (2006.01) |
| *B41F 21/00* | (2006.01) |

(52) U.S. Cl.
USPC ..... 347/104; 347/264; 101/474

(58) Field of Classification Search
USPC ..... 347/104, 264; 101/474
See application file for complete search history.

(56) References Cited

U.S. PATENT DOCUMENTS

| | | | | |
|---|---|---|---|---|
| 4,704,712 | A * | 11/1987 | Siryj | 720/676 |
| 6,481,820 | B1 * | 11/2002 | Tamura et al. | 347/19 |
| 6,879,378 | B2 * | 4/2005 | Morita et al. | 355/53 |
| 7,233,387 | B2 * | 6/2007 | Terada et al. | 355/72 |
| 7,607,647 | B2 | 10/2009 | Zhao et al. | |
| 8,056,893 | B2 | 11/2011 | Mandel et al. | |
| 2011/0048319 | A1 * | 3/2011 | Inoue et al. | 118/300 |

FOREIGN PATENT DOCUMENTS

| | | | | |
|---|---|---|---|---|
| WO | WO 2009116460 A1 * | 9/2009 | ..... | B65G 49/06 |

* cited by examiner

*Primary Examiner* — Laura Martin
*Assistant Examiner* — Jeremy Bishop
(74) *Attorney, Agent, or Firm* — Hoffmann & Baron, LLP

(57) ABSTRACT

Disclosed is an apparatus for transporting a substrate media sheet along a process path through a marking zone. The apparatus includes a marking zone, an air bearing support rail and a media cart. The marking zone marks the substrate media sheet. The air bearing support rail extends from a first location upstream of the marking zone to a second location downstream of the marking zone. The media cart conveys the sheet along the process path. The media cart includes a platen for holding the sheet thereon as the media cart translates through the marking zone. The media cart is supported along the process path between the first and second locations by the air bearing support rail. The air bearing support rail includes a gaseous layer providing a non-contact bearing support between an outer surface of the air bearing support rail and a non-contact support surface of the media cart.

16 Claims, 11 Drawing Sheets

AIR BEARING SUBSTRATE MEDIA TRANSPORT

TECHNICAL FIELD

The present disclosure relates to an apparatus for and method of transporting sheets of substrate media through a marking zone along an air bearing support rail.

BACKGROUND

Achieving high image quality in a printing assembly requires overcoming variants in static co-efficients and dynamic co-efficients of friction within a system. Controlling friction results in a precisely controlled speed, which is an important element of fine pixel placement. Also, pixel placement is a component of the media velocity as a marking element is placed on the sheet. Thus, it is desirable to control both the static and dynamic co-efficients of friction that are often associated with stick-slip, common to roller bearing systems.

Additionally, contemporary systems that exclusively use roller bearing elements for media carts are subject to wear and tear which further propagates miscalculations of velocity and/or position between the marking systems and the sheet to be marked. In this way, contemporary bearing surfaces and roller bearing assemblies make the repeatability of machine performance less consistent. Additionally, the wear and tear can increase the print head gap between print head surfaces and the substrate media sheet. When using inkjet technology, the downward spray of ink can fan out further than intended as a consequence of an increased print head gap, thus decreasing precision in the marking engine.

Additionally, contemporary roller bearing cart assemblies exhibit irregularities of positioning in a cross-process direction as well. Cart motion through a print zone is often accompanied by a cyclical back and forth motion across the marking zone resulting in nonlinear trajectory for the media cart and the sheet carrier thereon. Such a nonlinear trajectory can further diminish accuracy when attempting to mark the substrate media sheet.

Accordingly, it would be desirable to provide a media transport system and method for efficiently moving media through a print zone to permit high quality outputs and that overcomes other shortcomings of the prior art.

SUMMARY

According to aspects described herein, there is disclosed an apparatus transporting a sheet of substrate media along a process path through a marking zone. The apparatus includes a marking zone, an air bearing support rail and a media cart. The marking zone for marking a sheet of substrate media. The air bearing support rail extending from a first location upstream of the marking zone to a second location downstream of the marking zone. The media cart for conveying the sheet along the process path. The media cart including a platen for holding the sheet thereon as the media cart translates through the marking zone. The media cart supported along the process path between the first and second locations by the air bearing support rail. The air bearing support rail including a gaseous layer providing a non-contact bearing support between an outer surface of the air bearing support rail and a non-contact support surface of the media cart.

Additionally, the air bearing support rail can include a porous support surface over which the non-contact support surface moves. The gaseous layer can be formed by a gas emitted through the porous support surface. The gas can substantially includes air passing through the porous support surface. The air bearing support rail can include a horizontal support surface and a vertical bearing wall. The vertical bearing wall can include the gaseous layer formed thereon. The vertical bearing wall can guide lateral movement of the media cart. The marking zone can include a printing assembly. The printing assembly can be moveable laterally across at least a portion of the process path. The printing assembly is an inkjet assembly which can mark the sheet with no more than a single lateral pass. The media cart can include a contact bearing element. The contact bearing element can support the media cart in bearing engagement with the process pass upstream of the first location. The support track can provide an upstream path portion of the process path for the media cart. The upstream path can extend from a pre-marking zone location upstream of the first location at least to the first location. The contact bearing element can be in direct engagement with the support track as the media cart moves along the upstream path. The contact bearing element can include a set of support wheels. The direct engagement of the contact bearing element can be a rolling engagement. The transition ramp can switch the media cart between using the contact bearing element and the non-contact support surface. The transition ramp can be disposed on the process path between the upstream path and the first location.

According to further aspects described herein, there is disclosed method of conveying sheets of substrate media through a marking zone. The method including loading a substrate media sheet onto a media cart. The media cart including a platen for holding the substrate media sheet. The method also including conveying the media cart with the substrate media sheet thereon along an air bearing support rail extending from a first location upstream of a marking zone to a second location downstream of the marking zone. The air bearing support rail including a gaseous layer providing a non-contact bearing support between an outer surface of the air bearing support rail and a non-contact support surface of the media cart. The method further including marking the substrate media sheet as it passes the marking zone.

Additionally, the air bearing support rail can include a porous support surface over which the non-contact support surface moves. The gaseous layer can be formed by a gas emitted through the porous support surface. Forcing air to pass through a porous support surface of the air bearing support rail for forming the gaseous layer. The non-contact support surface of the media cart can move over the porous support surface with the gaseous layer there between. Controlling lateral movement of the media cart using a vertical bearing wall. The vertical bearing wall can prevent movement of the media cart in a cross-process direction. The gaseous layer can be formed on the vertical bearing wall disposed between the vertical bearing wall and a non-contact lateral control surface of the cart. Moving a print assembly laterally across a portion of the process path in the marking zone. The printing assembly is an inkjet assembly marking the substrate media sheet with no more than a single lateral pass. Conveying the media cart along a process path downstream of the second location. The air bearing support rail can not extend downstream beyond the second location. A contact bearing support surface of the media cart can engage a support track as the media cart is conveyed downstream beyond the second location. The media cart can move up a transition ramp at the second location. The contact bearing support surface can directly engage the support track as the media cart is conveyed downstream of the second location. The contact bearing element can include a set of support wheels. The direct engagement of the contact bearing element can be a rolling engagement. Conveying the media cart along the process path from an upstream location to the first location. The air bearing support rail can not extend upstream beyond the first location. The contact bearing support surface of the media cart can engage the support track as the media cart is conveyed from the upstream location to the first location.

DETAILED DESCRIPTION

Figure 1:
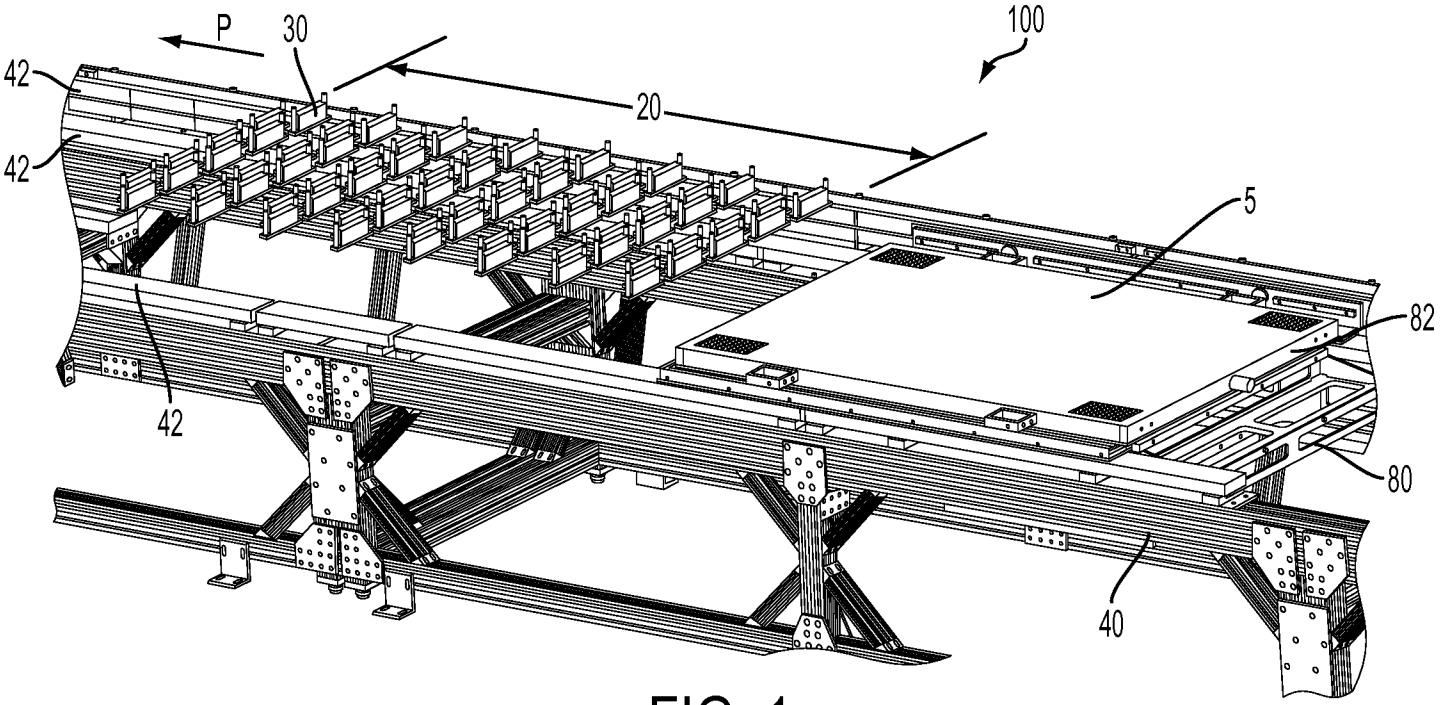
FIG. 1 is a perspective view of an apparatus for transporting a sheet of substrate media through a marking zone in accordance with an aspect of the disclosed technologies.

Describing now in further detail these exemplary embodiments with reference to the Figures. The disclosed technologies improve image quality for large format print jobs, while providing an efficient sheet handling system that can improve productivity. The apparatus and methods disclosed herein can be used in a select location or multiple locations of a marking device path that includes a media cart made to ride on a track. Thus, only a portion of an exemplary substrate media handling path is illustrated herein.

As used herein, "substrate media sheet", "substrate media" or "sheet" refers to a substrate onto which an image can be imparted. Such substrates may include, paper, transparencies, parchment, film, fabric, plastic, photo-finishing papers, corrugated board, or other coated or non-coated substrate media upon which information or markings can be visualized and/or reproduced. While specific reference herein is made to a sheet or paper, it should be understood that any substrate media in the form of a sheet amounts to a reasonable equivalent thereto. Also, the "leading edge" of a substrate media refers to an edge of the sheet that is furthest downstream in a process direction.

As used herein, "marking zone" refers to the location in a substrate media processing path in which the substrate media is altered by a "marking device." Marking devices as used herein include a printer, a printing assembly or printing system. Such marking devices can use digital copying, bookmaking, folding, stamping, facsimile, multi-function machine, and similar technologies. Particularly those that perform a print outputting function for any purpose.

Particular marking devices include printers, printing assemblies or printing systems, which can use an "electrostatographic process" to generate printouts, which refers to forming an image on a substrate by using electrostatic charged patterns to record and reproduce information, a "xerographic process", which refers to the use of a resinous powder on an electrically charged plate record and reproduce information, or other suitable processes for generating printouts, such as an ink jet process, a liquid ink process, a solid ink process, and the like. Also, a printing system can print and/or handle either monochrome or color image data.

As used herein, the terms "process" and "process direction" refer to a process of moving, transporting and/or handling a substrate media sheet. The process direction substantially coincides with a direction of a flow path P along which a portion of the media cart moves and/or which the image or substrate media is primarily moved within the media handling assembly. Such a flow path P is said to flow from upstream to downstream. Accordingly, cross-process, lateral and transverse directions refers to movements or directions perpendicular to the process direction and generally along a common planar extent thereof.

As used herein, "cart" or "media cart" refers to a media transport device translatable along a process path for conveying a substrate media sheet. Such a media transport device includes a frame holding a platen for directly supporting the substrate media sheet thereon. A cart or media cart as described herein can include a sled running on rails, a conveyance having wheels in rolling engagement with a track, other moveable carriage structure and/or any combination thereof.

An air bearing substrate media transport is disclosed which transports a sheet of substrate media along a process path through a marking zone with precision. The disclosed apparatus employs air bearings, referred to herein as "air bars," to aid in the positioning and orientation of the substrate media sheet as it passes through a marking zone. By providing precision motion quality, a marking device, such as an inkjet printing system, can accurately lay down an image on the substrate media. The substrate media sheet is conveyed on a platen mounted on a media cart that moves along a track defining the process path. The media cart includes rolling bearing wheels that roll along bearing surfaces on portions of the track. Also, the media cart includes non-contact bearing surfaces that allow the cart to float across air bars on other portions of the track, particularly across the marking zone. The media cart transitions from the rolling bearing support to the non-contact bearing support by way of a transition ramp that makes the media cart descend, allowing the air bars to take-over support of the cart on a thin layer cushion of air.

Once the media cart is supported by the air bars, it glides along in a virtually frictionless manner through the marking zone.

FIG. 1 shows the apparatus 100 including a media marking cart 80 conveying a substrate media sheet 5 along the process path 40 in a process direction P. The media cart 80 includes a platen 82 particularly suited for holding the sheet of substrate media 5. In this way, the substrate media sheet 5 should remain fixed relative to the platen 82, as the cart 80 moves along the process path 40. In this regard, various known hold-down techniques can be used to retain the sheet 5 on the platen 82, such as electrostatic, low vacuum pressure or mechanical fasteners. Also, in order to avoid having the sheet 5 crash into marking elements in the marking zone, such as the print heads, particular attention can be directed to holding down the leading edge of the sheet 5.

The process path 40 is formed by a set of tracks along which the media cart 80 is adapted to travel. FIG. 1 shows a portion of the tracks along the process path 40 that includes air bearing support rails 42 on opposed sides of the track for supporting the media cart 80 along the process path 40 through a marking zone 20. The tracks defining the process path 40 are illustrated as a linear path, particularly since the track portions shown in FIG. 1 pass through a marking zone, however other segments of the process path need not extend in the same direction shown and need not be straight. Also, not all segments of the process path 40 need to include the air bearing support rails 42.

The air bearing support rails 42 (also referred to herein as "air bars") provide non-contact bearing support surfaces over which the media cart 80 can glide across the marking zone 20. Unlike contact-roller bearings such as wheels that ride on a smooth low-friction rigid surface, air bars 42 utilize a thin film of pressurized air to provide an exceedingly low friction load-bearing interface between the track 40 and the media cart 80. A thin gaseous layer of air is formed over the air bars 42 over which non-contact bearing surfaces of the cart 80 can ride without touching the air bars 42 themselves. Being non-contact, air bars 42 avoid friction, wear, problems with particulates on the track and the need for lubricants. What is more, air bars 42 provide precision in positioning and are particularly suited for high-speed application. An example of air bearing technology is disclosed in U.S. Pat. No. 7,607,647 to Zhao et al., the disclosure of which is incorporated herein by reference.

The use of air bars 40 provides enhanced image quality by effectively overcoming the variance in static co-efficient and dynamic co-efficient of friction within the system. This reduced friction environment results in more precisely controlled speed and position of the transported substrate media sheet. Therefore this would provide improved pixel placement, particularly in an inkjet environment. Air bearing assemblies are particularly advantageous since both the static and dynamic coefficients of friction are equalized. This allows for the elimination of stick-slip that is generally associated with roller bearing systems. Particularly, by reducing static friction to virtually zero, it is possible to achieve higher resolution and repeatability. Also, with the elimination of contact bearing surfaces between moving elements, the reduction of wear and tear further eliminates the propagation of additional errors in marking accuracy. Further, by eliminating the contact surfaces, particularly in the marking zone, the system can see reduced maintenance costs and labor, considering no lubricants (or at least less lubricants) are needed for the system. Air bearings are also advantageous in that they are self-purging, with constant air exiting the surface, which blows fibers and contaminants from the process path. Also, the non-contact surface eliminates variations associated with surface finish or irregularities of a stick-slip system. Using a non-contact bearing surface averages out surface profiles and results in a straighter trajectory of motion. Also, the air bars 42 provide repeatability and accuracy of the print head gap as discussed further below.

As shown in FIG. 1, air bars 42 extend through the marking zone 20 from upstream along the track 40, beyond the marking zone 20 downstream along the track 40. In this way, the air bars 42 are used for controlling motion quality within the marking zone as the substrate media sheet 5 is delivered therein. Three sets of air bars 42 are included in the embodiment shown. Two of the air bars 42 extend along opposed sides of the track 40 for supporting a vertical weight-bearing load of the media cart 80, while a third air bar 42 extends along one lateral side of the track for controlling lateral cart movement. In this way, the cart 42 also glides along a lateral air bar 42 maintaining precise position in a cross-process direction.

FIGS. 2-5 show the media cart 80 as it translates along the process path 40 in a process direction P. In addition to the non-contact bearing surfaces that ride along the air bars 42, the media cart 80 can include contact-bearing elements for supporting the cart along portions of the process path 40 that do not include air bars 42. FIGS. 2-5 show portions of contact bearing support surfaces 50 (also referred to herein as "bearing track") that form part of the tracks 40 in areas where no air bars 42 are provided. Thus, the media cart 80 includes a set of rolling bearing wheels which ride along the bearing track 50 that extends along the process path 40. Also, a transition ramp 60 is provided for moving the media cart 80 from one type of support surface to the other and visa-versa.

As the cart 80 approaches the marking zone 20, the carts rolling bearing wheels ride down a transition ramp 60 that causes the cart 80 and particularly the cart wheels to descend lower than the upper surface of the bearing track 50. As the cart 80 descends down the transition ramp 60, non-contact bearing surfaces 90 of the media cart 80 take over the bearing support of the cart 80. Thereafter, the cart 80 is conveyed along the air bars 42 while the wheels no longer engage a bearing surface. In this way, the media cart 80 glides along a gaseous layer of the air bars 42, providing a virtually frictionless motion as the cart 80 moves across the marking zone 20. In this way, the apparatus 100 exquisitely controls the velocity and position of the substrate media sheet 5.

Figure 3:
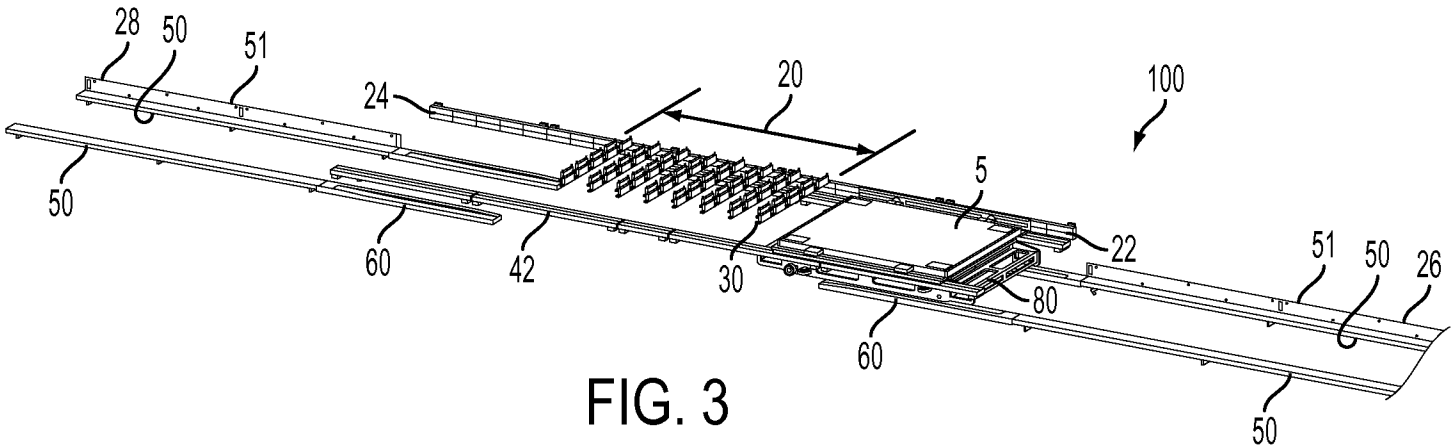
FIG. 3 is a perspective view of the media cart shown in FIG. 1 as it approaches a marking zone including additional upstream and downstream segments of a process path in accordance with an aspect of the disclosed technologies.

FIG. 3 shows an extended track assembly that includes some bearing track 50 upstream of the marking zone as well as some bearing track 50 downstream of the marking zone. In this way, the media cart 80 travels from an upstream location 26 towards the transition ramp 60 where the cart 80 makes a transition from being supported by rolling bearing wheels to non-contact bearing surfaces of the media cart. Overlapping the transition ramp 60 are portions of the air bars 42 which extend from a first location 22 along the process path 40 to a downstream second location 24 also along the media path 40. Between the first and second locations 22, 24 is the marking zone 20. A further downstream location 28 of the media path is shown on the left most portion of FIG. 3. However, it should be understood that the media path 40 can extend further than downstream location 28. Also, further segments of track or additional marking zones can be added as suited.

Figure 2:
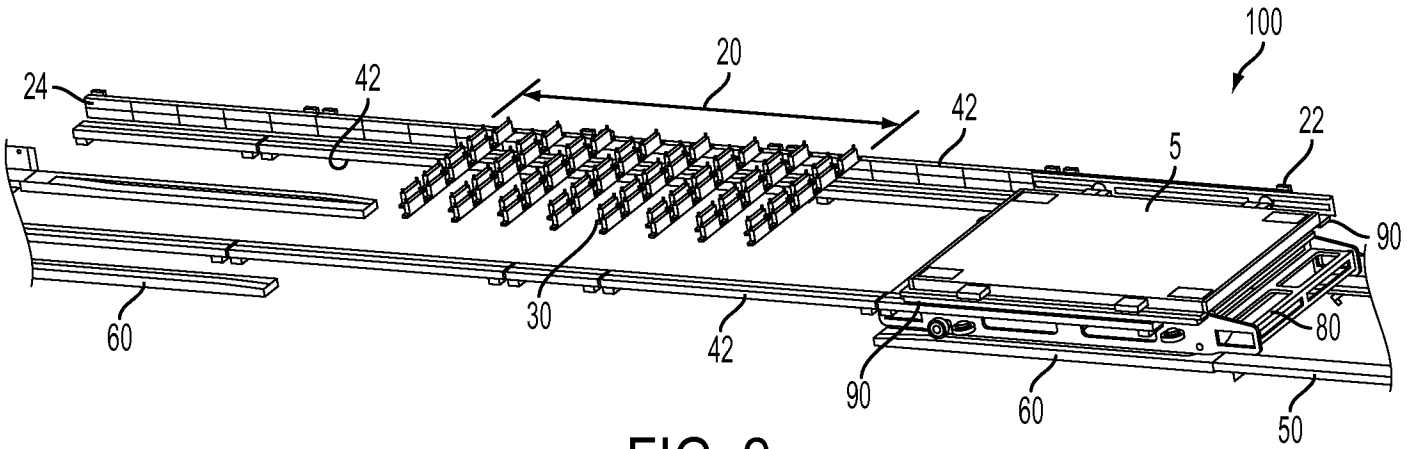
FIG. 2 is a perspective view of the media cart shown in FIG. 1 as it reaches an air bearing support rail in accordance with an aspect of the disclosed technologies.
Figure 4:
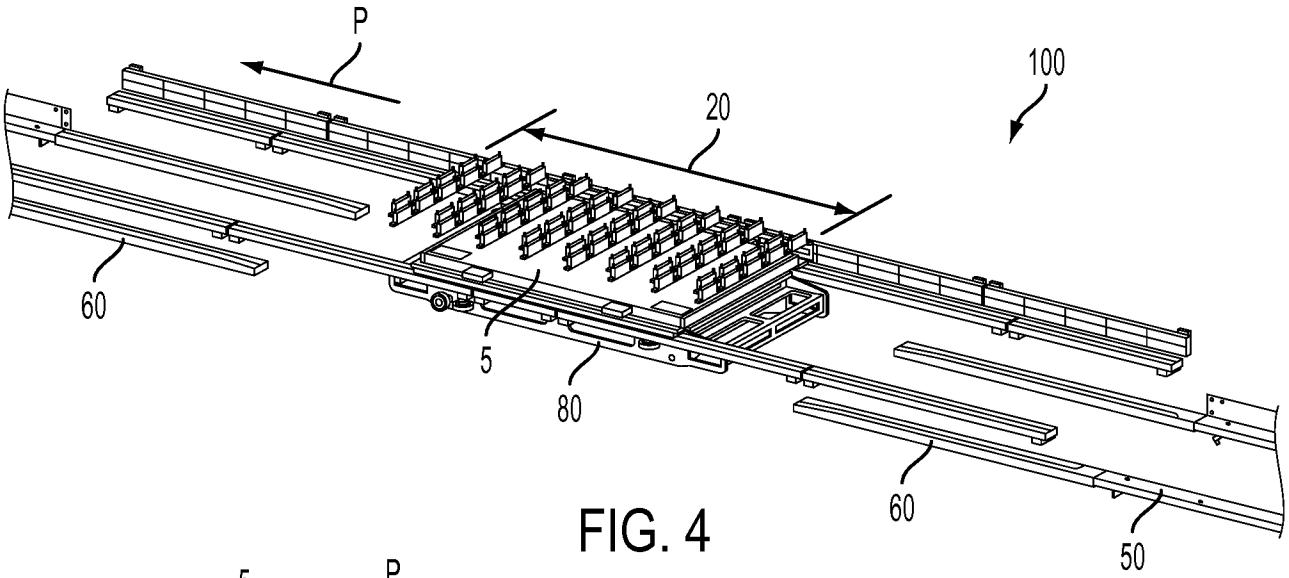
FIG. 4 is a perspective view of the media cart shown in FIG. 1 passing through a marking zone in accordance with an aspect of the disclosed technologies.
Figure 5:
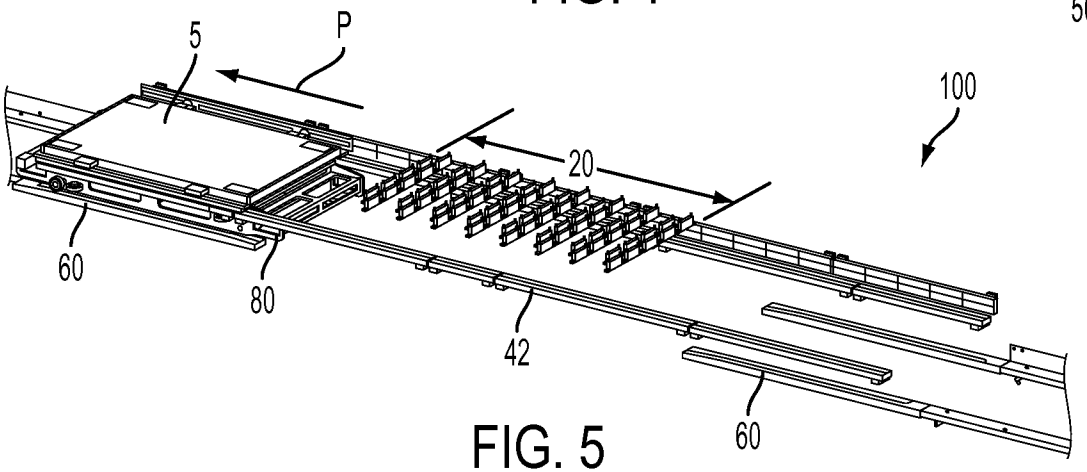
FIG. 5 is a perspective view of the media cart shown in FIG. 1 after passing the marking zone in accordance with an aspect of the disclosed technologies.

FIG. 2 shows the media cart 80 while on the transition ramp 60 just before transitioning to be supported by the non-contact bearing surfaces 90 of the media cart 80. Slightly downstream of the position shown in FIG. 2, FIG. 3 shows the media cart no longer riding on the rolling bearing wheels and now supported by the air bars 42. As the cart continues in the process direction P, FIG. 4 shows the media cart 80 having arrived within the marking zone 20. Thereafter, the media cart 80 can continue towards the downstream transition ramp 60 where the rolling bearing wheels take over support of the media cart 80 again, thereby lifting the media cart off of the air bars 42. In this way the media cart can continue in rolling engagement with the track 40 further downstream.

Figure 6:
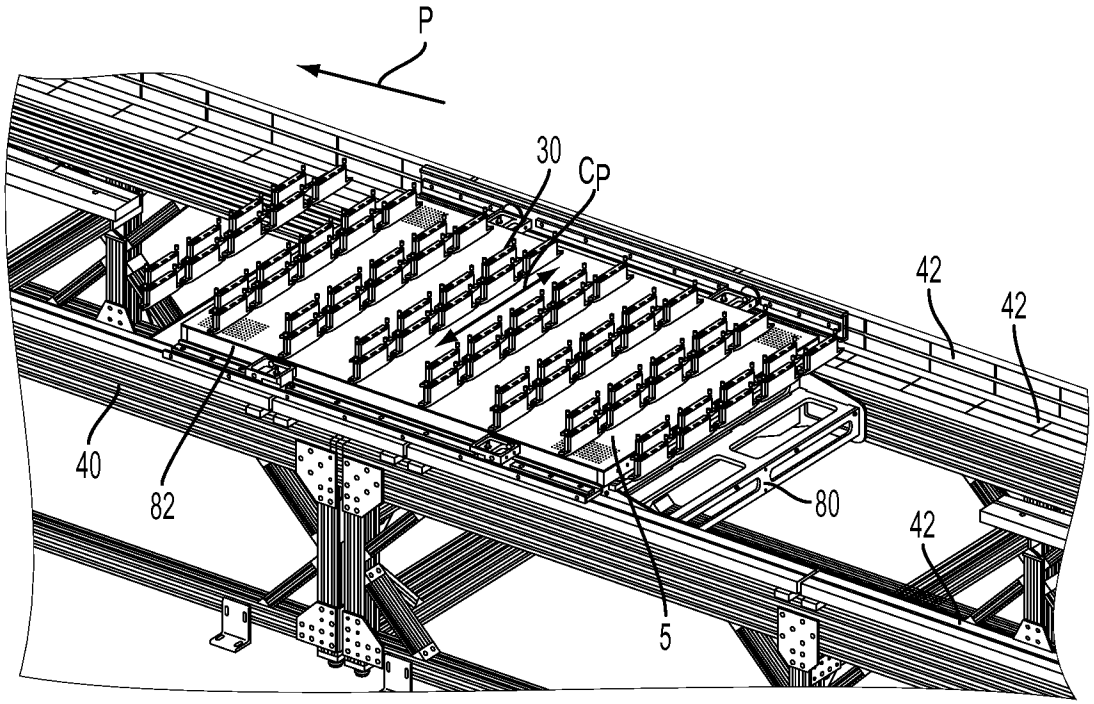
FIG. 6 is a perspective view of the media cart shown in FIG. 1 in the marking zone as an inkjet assembly moves in a cross process direction to mark a substrate media sheet in accordance with aspects of the disclosed technologies..
Figure 7:
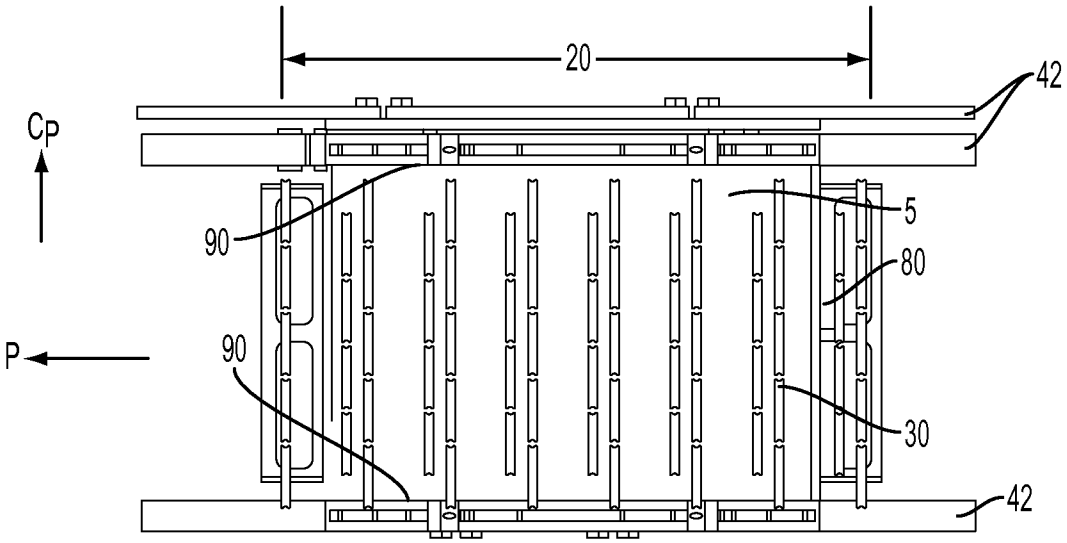
FIG. 7 is a plan view of the media cart shown in FIG. 1 of FIG. 6.
Figure 8:
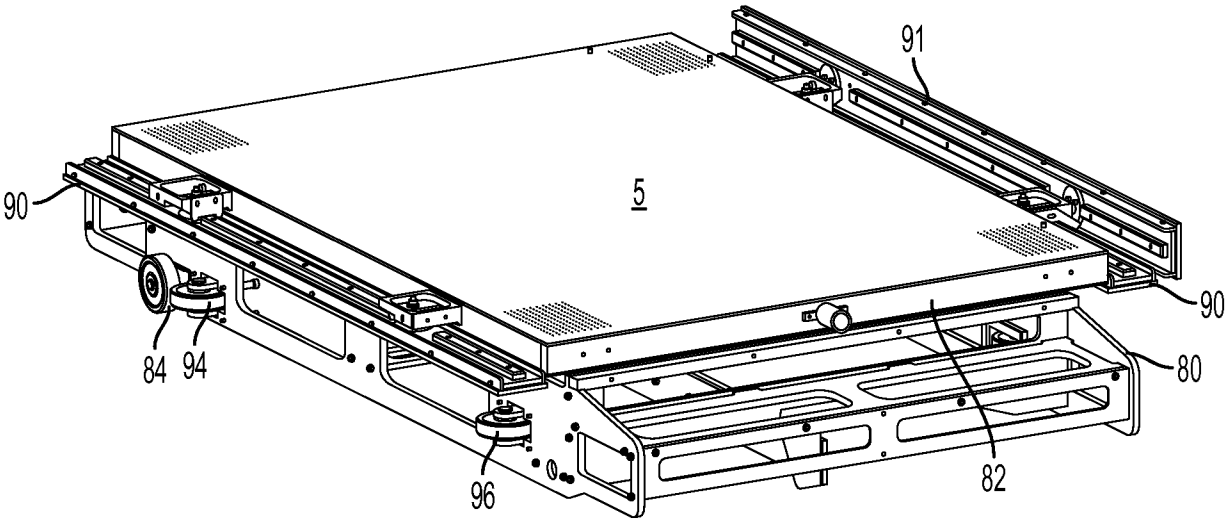
FIG. 8. is a perspective view of a media cart in accordance with aspects of the disclosed technologies.

In accordance with an aspect of the disclosed technologies, within the marking zone 20, an image is imparted to the substrate media sheet 5 by an inkjet printing system 30. FIGS. 6 and 7 show a representation of an inkjet assembly 30 within the marking zone 20. The inkjet assembly 30 is represented by an array of smaller inkjet heads, although it should be understood that further support structure would carry such inkjet heads, moving them in unison and/or with synchronized movement. Staggering numerous small print-heads creates a wide jetting array that can provide a very fast printing assembly. An 8-color print assembly is shown that includes series of rows of inkjet heads extending in a cross-process direction. Each row or pairs of rows (as shown) can provide a single color, but together all the rows provide the necessary colors. It should be understood that while an 8-color print assembly is illustrative, fewer or greater numbers of rows or colors are within the scope of the disclosed technologies.

As the target substrate media 5 is carried by the media cart 80 in the marking zone, the velocity of the media cart 80 is tightly controlled. Nonetheless, the printing system, such as the inkjet assembly 30, must target the substrate media 5 as it passes. While the air bearings assist in positional precision of the target substrate media, a further aspect of the disclosed technologies applies the ink jet marking using a cross-process movement of the inkjet assembly 30. As the media cart passes through the marking zone 20, the inkjet heads of the inkjet assembly 30 are made to move across the substrate media sheet 5 as it passes. The inkjet assembly 30 thus moves in a cross-process direction $C_P$, which extends laterally relative to the process direction P. In accordance with one aspect of the disclosed technology, the inkjet assembly 30 marks the substrate media sheet 5 with a single lateral pass in the cross-process direction $C_P$. Providing a single pass architecture further minimizes variations in sheet registration which can occur trying to target the sheet again on a second or subsequent pass. Nonetheless, it should be understood that while an inkjet system is illustrated and described herein, a variety of devices for generating an image could be alternatively and/or additionally used. For example, xerographic, flexographic or lithographic image transfer systems could be employed.

FIG. 7 shows a plan view of the media cart 80 as it passes through the marking zone 20. As shown, the inkjet assembly 30 is shown shifted closer to one of the two lateral sides of the tracks 40 (toward the bottom of FIG. 7). Thus, the inkjet assembly 30 could either start in this position and move in the cross-process direction to the opposed side in order to mark the sheet 5, or start from the other side and finish in the position shown. It should be understood that each row of inkjet heads need not move across the sheet for printing at the same time.

FIG. 7 also shows non-contact bearing surfaces 90 of the media cart 80 that glide along the air bars 42. Thus, the media cart 80 includes two opposed elongate surfaces that act as a non-contact bearing surface 90 for supporting the weight of the cart. Those non-contact bearing surfaces 90 ride along a thin film of air that is created on an upper surface of the air bars 42.

FIGS. 8-11 show further details of the media cart 80. The media cart includes a platen 82 for holding the substrate media sheet 5. It should be understood that the platen 82 should be designed large enough to hold the desired size of the substrate media sheet. In particular, the apparatus of the presently disclosed technologies can be used for large sheets such as large size paper having dimensions of 62"×42". However, the platen and cart could be made to almost any desired size. The track 40 would presumably need to conform to the appropriate size of the cart 80.

The media cart 80 includes a pair of front rolling bearing wheels 84 and rear bearing wheels 86. The front and rear bearing wheels 84, 86 are intended to ride along the bearing track 50. It should be further noted that the front bearing wheels 84 are disposed further towards the opposed lateral edges of the track 40, while the rear rolling bearing wheels 86 are slightly inset, relative to the front bearing wheels 84. This offset design between the front and rear rolling bearing wheels 84, 86 enables the platen 82 to remain level horizontally, as the cart moves across each transition ramp 60 on opposed sides of the marking zone 20. As shown in FIG. 12, the transition ramp 60 includes an inside bearing surface 63 and an outside bearing surface 65. Also the transition ramp 60 includes an inside ramped portion 64 and an outside ramped portion 66. This design is intended so that the rear roller bearing wheels 86 ride down the inside transition ramp 64, while the forward rolling bearing wheels 84 simultaneously ride down the outside transition ramp portion 66. It should be noted that the transition ramp portion shown in FIG. 12 corresponds to the similar portion of the transition ramp shown on the lower right hand portion of FIG. 11 (viewed from the opposite side).

The transition ramp(s) 60 are used to move the media cart 80 from the bearing track 50 onto the air bars 42 and then from the air bars 42 back onto further bearing track 50 on the downstream side of the marking zone 20. Thus, the rolling bearing wheels 84, 86 carry the media cart 80 along the bearing track 50 from an upstream position 26 to a first pair of opposed transition ramps 60 (one ramp on each lateral side of the track, aligned with sections of bearing track). Initially while moving along the transition ramp (as shown in FIG. 2), the rolling bearing wheels 84, 86 carrying the cart and the non-contact bearing surfaces 90 of the media cart pass over initial segments of the air bars 42. Over that initial segment of the transition ramp 60, there is a gap G between the non-contact bearing surfaces 90 of the media cart 80 and the air bars 42. Then, as the media cart 80 continues down the process path, the rolling bearing wheels 84, 86 descend down the inside/outside ramped portions 64, 66, making the gap G between the non-contact bearing surfaces 90 and the air bars 42 decrease. Eventually, as the gap G gets small enough and before the non-contact bearing surfaces 90 of the cart actually engage the air bars 42, the gaseous layer of air formed on the top surface of the air bars 42 will support the weight of the cart. This relieves the rolling bearing wheels 84, 86 of their load burden. Thus, once the air bars 42 support the media cart 80, no bearing track 50 is needed across that segment of the process path 40. In this way, (as shown in FIGS. 2-5) no horizontal bearing tracks 50 or lateral bearing walls 51, are provided between the two sets of transition ramps 60 spaced apart in the process direction P.

Figure 9:
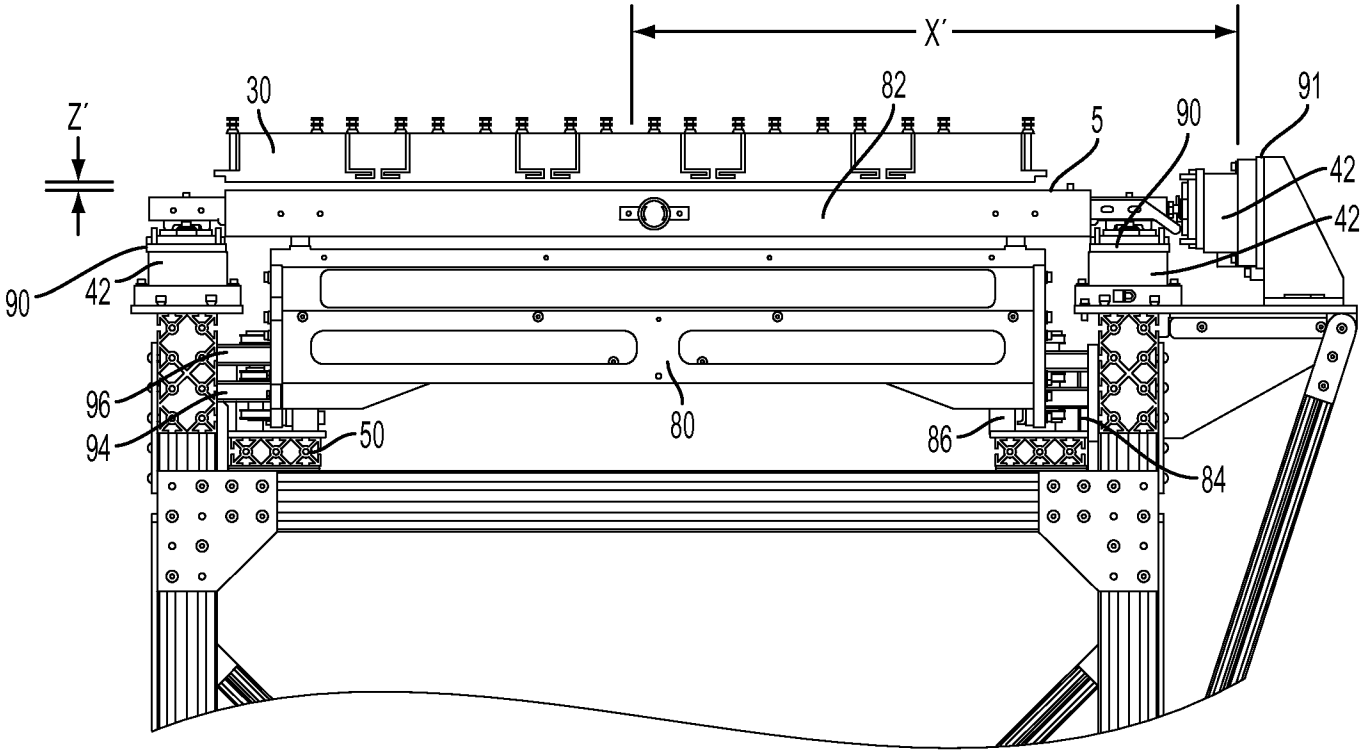
FIG. 9. is a front elevation view of the apparatus of FIG. 1 viewed from downstream of the marking zone looking upstream.

FIG. 9 shows a front view of the cart 80 looking down a section of the track from a position downstream of the printing zone 20 coincident with the downstream end the transition ramps 60. In this view the media cart has not yet reached the downstream transition ramps 60 (for example as shown in FIG. 4). Thus, in FIG. 9 while the front and rear rolling bearing wheels 84, 86 appear to be engaging the bearing track 50, the rolling bearing wheels 84, 86 at that point are actually hanging just below the bearing track surface, since the media cart 80 is carried by the air bars 42 at that point. Thus, the rolling bearing wheels 84, 86 shown in FIG. 9 are actually behind (in the orientation shown) and not engaged with the section of bearing track 50 shown.

Additionally, FIG. 9 illustrates the interaction of the air bars 42 with the media cart non-contact bearing surfaces 90. In particular, two opposed sets of air bars 42 are disposed on opposed sides the media cart 80. The air bars 42 have a broad and substantially flat upper planar surface that conforms to a flat non-contact bearing surface of the media cart to glide over it. It should be understood that while a non-planar air bearing surface could alternatively be used for the air bars 42, then the non-contact bearing surfaces 90 of the media cart should be made to match or conform to such an alternative shape for the air bars. Using the two sets of air bars 42, one on each lateral side of the track, allows exquisite control of the vertical space Z' between the surface of the substrate media sheet 5 carried on the platen 82 and the lowest surface of the print heads 30.

Additionally, in order to maintain lateral position control, the media cart 80 includes lateral spring loaded wheels 94, 96 on the lower portion of the cart. Those lateral spring loaded wheels 94, 96 provide a generalized lateral control along the process path 40. While riding the segments of bearing track 50, the lateral spring loaded wheels 94, 96 can engage lateral side walls of the track, such as lateral wall 51 shown upstream and downstream of the marking zone 20 in FIG. 3. Such a lateral wall 51 can be provided on both sides of the process path as needed. In fact, across the marking zone 20 the lateral spring loaded wheels 94, 96 can further ensure that the media cart 80 is biased towards the third air bar 42 used for lateral control. It should be noted that lateral walls 51 can also be provided along those segments of the process path that coincide with the air bars, in order to provide lateral stability across the marking zone. In particular, the lateral spring loaded wheels 94, 96 can bias the media cart toward one lateral side that includes a vertical stability wall 91. Similar to the non-contact bearing surfaces 90, the vertical stability wall can glide along the third air bar 42, which rises vertically above the other two air bars. In this way the lateral spring loaded wheels 94, 96 maintain the vertical stability wall biased toward the third air bar 42. The third air bar should at least extend across the marking zone 20, but they can extend further. In the illustrative examples, the third air bar is provided along the same extent as the lower two air bars. This allows the media cart 80 to stabilize any lateral movement by the time it reaches the marking zone.

Figure 10:
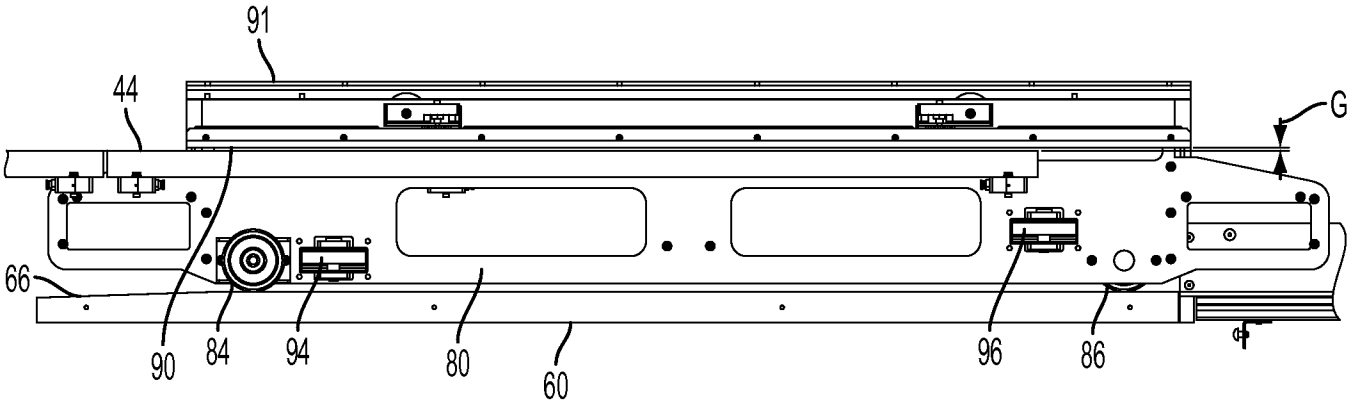
FIG. 10. is a side elevation view of a media cart on a segment of the process path in accordance with aspects of the disclosed technologies.

FIG. 10 shows a side elevation view of the media cart traveling along the transition ramp 60. Here the horizontal non-contact bearing surface 90 and the vertical non-contact bearing stability wall 91 can be seen (no third vertical air bar is shown in order to make the non-contact bearing surfaces of the media cart more visible). It should be noted that while the two lower air bars 42 are shown in FIG. 10, the sub assembly of the track 40 has been removed in order to more clearly see the interaction of the media cart 80 with the air bars 42. The offset position of the front and rear rolling bearing wheels 84, 86 is visible. In particular, the front rolling bearing wheels 84 are disclosed towards the outside of the cart frame while the rear rolling bearing wheels 86 are situated on the inner side of the cart frame. Similarly, the lateral spring loaded wheels 94, 96 have an offset configuration. In this way, the front lateral spring loaded wheels 94 are disposed vertically lower than the rear lateral spring loaded wheels 96. It should be noted that while FIG. 10 shows a gap G between the non-contact bearing surface 90 and an upper porous surface 44 of the air bars, this gap is slightly larger than the gaseous film layer that will eventually support the media cart as it rides across the air bars.

Figure 11:
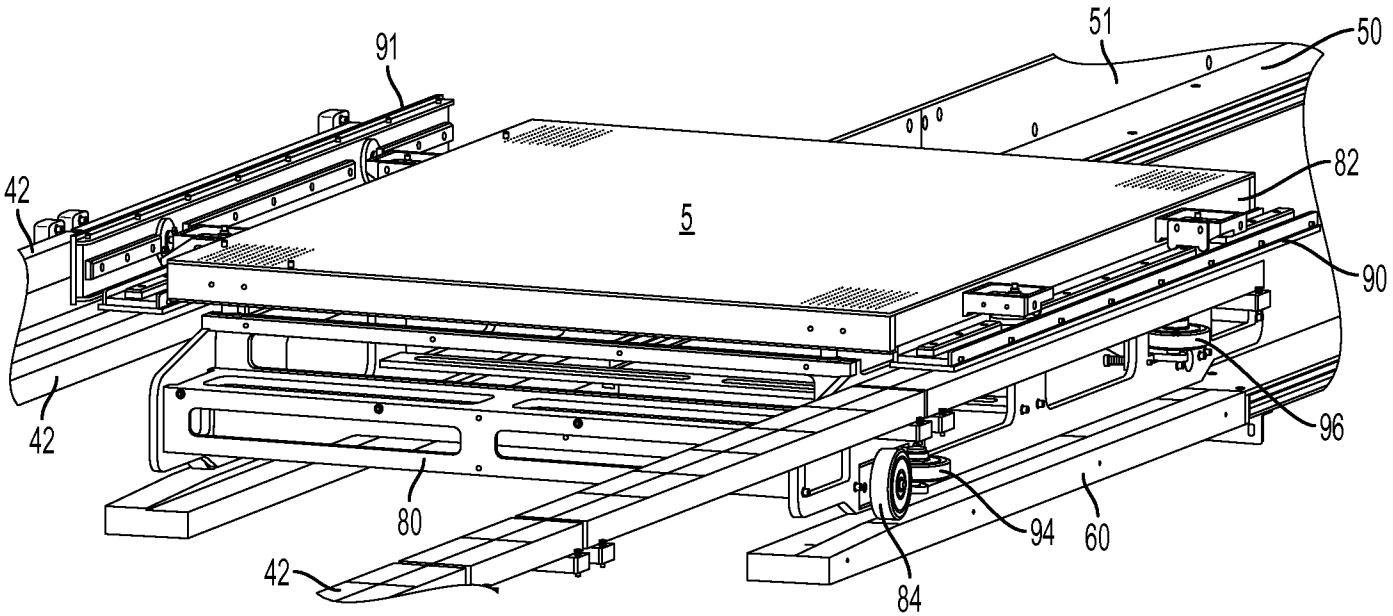
FIG. 11. is a perspective view of the media cart and the segment of the process path of FIG. 10.
Figure 12:
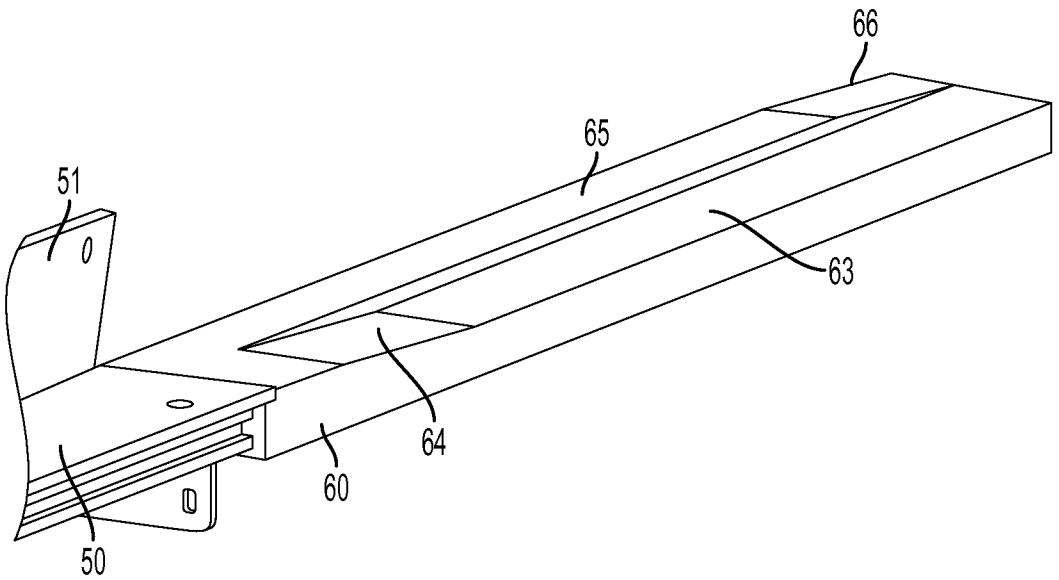
FIG. 12. is a perspective view of a transitional portion of the media process path.

FIG. 11 is a perspective view for a similar portion of track at that shown in FIG. 10. As the media cart 80 crosses the transition ramp 60, the non-contact bearing surfaces 90 of the media cart will start riding along the air bars 42, leaving the rolling bearing wheels 84, 86 hanging and no longer in rolling engagement with the track.

Figure 13:
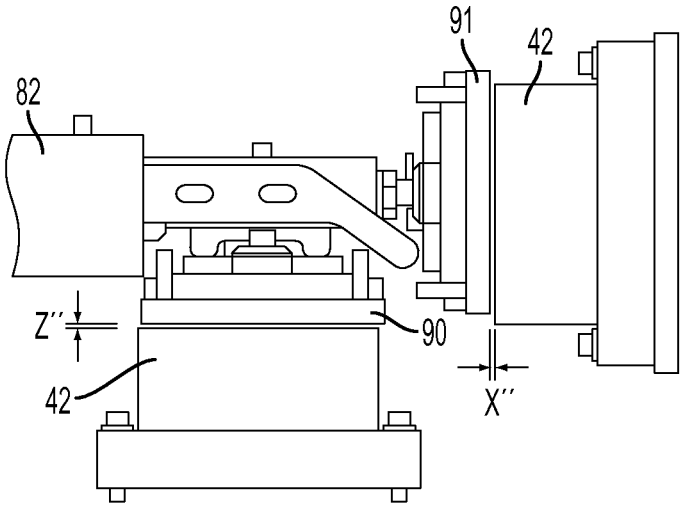
FIG. 13. is a front elevation relief view of airbearing support rails with a portion of the media cart in accordance with aspects of the disclosed technologies.

FIG. 13 shows a relief view of the interaction between non-contact bearing surfaces 90 and the vertical stability wall 91 of the cart with the horizontal and vertical air bars 42. In particular, the horizontal and planar non-contact bearing surface 90, once riding on the gaseous layer Z"of air formed on the air bars 42 will support the weight of the media cart 80 and the sheet 5 thereon. The air bars 42 include a porous upper surface 44 (facing the non-contact bearing surface 90—noted in FIG. 10) that emits pressurized air from inside the air bars 42. Similarly, the vertical wall 91 rides on a gaseous film layer X" disposed between that vertical wall 91 and the third, vertically oriented, air bar 42 on the right of FIG. 13. It should be understood that while the air bars typically have air fed into them so that it can seep through the upper porous surfaces 44, other gases could be used to provide the gaseous layers Z", X" between the non-contact bearing surfaces 90, 91 and the air bars 42.

Figure 14:
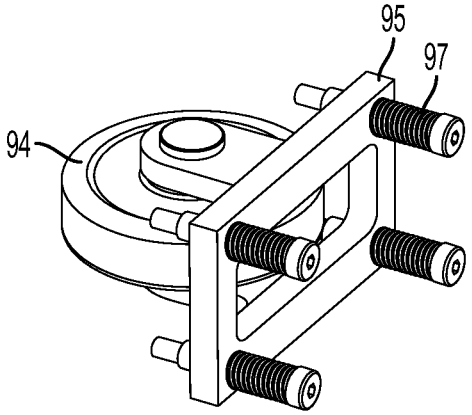
FIG. 14. is a perspective view of a lateral spring loaded wheel assembly in accordance with aspects of the disclosed technologies.

FIG. 14 shows a relief view of the lateral spring loaded wheels 94. It should be noted that the lateral spring loaded wheels 96 can be substantially the same as that shown in FIG. 14. The lateral spring loaded wheels 94, 96 include a spring loaded wheel support bracket 95 and biasing elements 97 particularly in the form of springs. Once mounted to the media cart 80, this assembly will bias the cart laterally. In particular, a lateral biasing can provide that encourages the media carts vertical wall 91 towards the vertical side air bars 42. It should be understood that alternative mechanisms can be used for laterally biasing the media cart in place of and/or in addition to the lateral spring loaded wheels 94, 96.

In accordance with aspects of the disclosed technologies, the media cart 80, the printing system 30 or other parts of the apparatus 100 can be operated by a controller (not shown). The controller may also control any number of functions and systems within the overall apparatus 100. The controller may include one or more processors and software capable of generating control signals. Through the coordinated control of the apparatus sub-elements, including the cart movement and the printing systems, the substrate media sheet 5 may be efficiently handled and marked. For example, the media cart 80 can be made to accelerate, decelerate or even stop at various locations along the process path. Similarly, the timing and speed of the printing system 30 can be controlled to maintain improved image quality.

It will be appreciated that variations of the above-disclosed and other features and functions, or alternative thereof, may be desirably combined into many other different systems or applications. Various presently unforeseen or unanticipated alternatives, modifications, variations, or improvements therein may be subsequently made by those skilled in the art which are also intended to be encompassed by the following claims. In addition, the claims can encompass embodiments in hardware, software, or a combination thereof.

What is claimed is:

1. An apparatus transporting a sheet of substrate media along a process path through a marking zone, the apparatus comprising:

a marking zone for marking a sheet of substrate media;

a first air bearing support rail extending from a first location upstream of the marking zone to a second location downstream of the marking zone, the first air bearing support rail having a porous support surface;

a media cart for conveying the sheet along a process path, the media cart including a platen for holding the sheet thereon as the media cart translates through the marking zone, the media cart supported along the process path between the first and second locations by a gaseous layer formed by a gas emitted through the porous support surface of the first air bearing support rail, the gaseous layer providing a non-contact bearing support between an outer surface of the first air bearing support rail and a non-contact support surface of the media; and a second air bearing support rail extending along one lateral side of the marking zone defining a vertical bearing wall disposed to limit movement of the media cart in a cross-process direction, the second air-bearing support rail having a porous support surface of the second air-bearing support rail to emit gas through to define a second gaseous layer, the second gaseous layer providing a non-contact bearing support between the second air bearing support rail and the media cart.

2. The apparatus as defined in claim 1, wherein the gas substantially includes air passing through the porous support surfaces.

3. The apparatus as defined in claim 1, wherein the marking zone includes a printing assembly, the printing assembly moveable laterally across at least a portion of the process path.

4. The apparatus as defined in claim 3, wherein the printing assembly is an inkjet assembly marking the sheet with no more than a single lateral pass.

5. The apparatus as defined in claim 1, wherein the media cart includes a contact bearing element, the contact bearing element supporting the media cart in bearing engagement with a process pass upstream of the first location.

6. The apparatus as defined in claim 5, further comprising:

a support track further providing an upstream path portion of the process path for the media cart, the upstream path portion extending from a pre-marking zone location upstream of the first location to at least the first location, the contact bearing element being in direct engagement with the support track as the media cart moves along the upstream path portion.

7. The apparatus as defined in claim 6, wherein the contact bearing element includes a set of support wheels, the direct engagement of the contact bearing element being a rolling engagement.

8. The apparatus as defined in claim 6, further comprising:

a transition ramp for switching the media cart between using the contact bearing element and the non-contact support surface, the transition ramp disposed on the process path between the upstream path and the first location.

9. A method of conveying sheets of substrate media through a marking zone comprising:

loading a substrate media sheet onto a media cart, the media cart including a platen for holding the substrate media sheet;

conveying the media cart with the substrate media sheet thereon along an air bearing support rail extending from a first location upstream of a marking zone to a second location downstream of the marking zone, the air bearing support rail not extending downstream beyond the second location, the air bearing support rail including a gaseous layer providing a non-contact bearing support between an outer surface of the air bearing support rail and a non-contact support surface of the media cart;

marking the substrate media sheet as it passes the marking zone; and further conveying the media cart along a process path downstream of the second location, the media cart moving up a transition ramp at the second location and a contact bearing support surface of the media cart directly engaging a support track downstream of the second location.

10. The method as defined in claim 9, wherein the air bearing support rail includes a porous support surface over which the non-contact support surface of the media cart moves, the gaseous layer being formed by a gas emitted through the porous support surface.

11. The method as defined in claim 9, further comprising:

forcing air to pass through a porous support surface of the air bearing support rail for forming the gaseous layer, the non-contact support surface of the media cart moving over the porous support surface with the gaseous layer there between.

12. The method as defined in claim 9, further comprising:

controlling lateral movement of the media cart using a vertical bearing wall, the vertical bearing wall preventing movement of the media cart in a cross-process direction, wherein the gaseous layer is formed on the vertical bearing wall disposed between the vertical bearing wall and a non-contact lateral control surface of the media cart.

13. The method as defined in claim 9, further comprising:

moving a print assembly laterally across a portion of the process path in the marking zone.

14. The method as defined in claim 13, wherein the printing assembly is an inkjet assembly marking the substrate media sheet with no more than a single lateral pass.

15. The method as defined in claim 9, wherein the media cart includes a contact bearing element, the contact bearing element including a set of support wheels, a direct engagement of the contact bearing element being a rolling engagement.

16. The method as defined in claim 9, further comprising:

conveying the media cart along the process path from an upstream location to the first location, the air bearing support rail not extending upstream beyond the first location, the contact bearing support surface of the media cart engaging the support track as the media cart is conveyed from the upstream location to the first location.

* * * * *